US005961378A

United States Patent [19]

Inaba

[11] Patent Number: 5,961,378

[45] Date of Patent: Oct. 5, 1999

[54] POLISHING APPARATUS

[75] Inventor: Takao Inaba, Mitaka, Japan

[73] Assignee: Tokyo Seimitsu Co., Ltd., Tokyo, Japan

[21] Appl. No.: 09/021,451

[22] Filed: Feb. 10, 1998

[30] Foreign Application Priority Data

Feb. 10, 1997 [JP] Japan ..... 9-026729

[51] Int. Cl.[6] ..... B24B 7/22

[52] U.S. Cl. ..... 451/259; 451/494

[58] Field of Search ..... 451/259, 288, 451/494, 505, 287, 41

[56] References Cited

U.S. PATENT DOCUMENTS 1,291,572 1/1919 Lorenz ..... 451/494
5,584,750 12/1996 Ishida et al. ..... 451/288
5,704,827 1/1998 Nishi et al. ..... 451/287

FOREIGN PATENT DOCUMENTS 4053682 2/1992 Japan ..... 451/494
643298 1/1979 U.S.S.R. ..... 451/446

*Primary Examiner*—Robert A. Rose
*Attorney, Agent, or Firm*—Sixbey, Friedman, Leedom & Ferguson; David S. Safran

[57] ABSTRACT

A polishing apparatus is provided with a turn table, on which an air passage is formed, and a polishing pad mount plate, on which a polishing pad is stuck. The polishing pad mount plate is detachably attached on the turn table. When the polishing pad mount plate is detached from the turn table, a separation fluid supplying part supplies air as separation fluid between the turn table and the polishing pad mount plate through the air passage.

4 Claims, 2 Drawing Sheets

POLISHING APPARATUS

BACKGROUND OF THE INVENTION

1. Field of the Invention

The present invention relates to a polishing apparatus provided with a polishing pad which polishes a polished material, and more particularly to a polishing apparatus in which polishing pads can be easily and quickly changed.

2. Description of Related Art

In a process of manufacturing semiconductor chips in which circuits are formed on a wafer of semiconductor material, the surface of the semiconductor wafer is polished. In this process, a variety of polishing apparatuses are usually used which are provided with a polishing pad which is stuck on a polishing table and polishes the semiconductor wafer.

When the polishing pads are changed in the above-mentioned conventional polishing apparatus, the used polishing pad must be torn off on the polishing table, and thereby the dust is scattered inside the apparatus. Hence, the process may become complicated because of the cleaning. Moreover, while the polishing pads are changed, the apparatus must stop the whole time. For this reason, it is difficult to increase the number of semiconductor wafers to be polished by the apparatus.

SUMMARY OF THE INVENTION

To solve the above-mentioned problem, a polishing apparatus according to the present invention includes a polishing pad mount plate on which a polishing pad is stuck, and the polishing pad mount plate is detachably attached on a polishing table. Then, the polishing pads are changed by replacing the polishing pad mount plate with another on which a new polishing pad is stuck. Thus, the polishing apparatus stops for only a short period of time. Moreover, after the detached polishing pad mount plate is moved to a place away from the polishing apparatus, the used polishing pad is torn off there, and thereby the dust can be prevented from scattering inside the apparatus.

If the polishing apparatus includes the polishing pad mount plate, however, it may be difficult to detach the polishing pad mount plate from the polishing table. That is because, if both the polishing table and the polishing pad mount plate have contacting surfaces of plane, the polishing pad mount plate sticks fast to the polishing table when the polishing liquid permeates between the contacting surfaces.

The present invention has been developed in view of the above-described circumstances, and has as its object the provision of a polishing apparatus in which polishing pads can be easily and quickly changed.

In order to achieve the above-stated object, a polishing apparatus of the present invention comprises: a polishing table; a polishing pad mount plate on which a polishing pad for polishing a polished material is attached, the polishing pad mount plate being detachably attached on the polishing table; a separation fluid passage formed on at least one of the polishing table and the polishing pad mount plate; and a separation fluid supplying part which supplies separation fluid between the polishing table and the polishing pad mount plate through the separation fluid passage when the polishing pad mount plate is detached from the polishing table.

According to the present invention, when the polishing pad mount plate is detached from the polishing table, the separation fluid supplying part supplies the separation fluid between the polishing table and the polishing pad mount plate through the separation fluid passage to thereby release the polishing pad mount plate from the polishing table.

The polishing apparatus of the present invention further comprises a polishing pad mount plate moving part which moves the polishing pad mount plate in a direction to become farther from the polishing table and supports the polishing pad mount plate when the polishing pad mount plate is detached from the polishing table. Thus, the polishing pad mount plate is supported and moved in a direction to separate from the polishing table after the polishing pad mount plate is released from the polishing table.

The polishing apparatus of the present invention is characterized in that: the polishing table is movable in a polishing direction; and the separation fluid supplying part comprises a separation fluid injector which injects the separation fluid, and a separation fluid injector moving part which connects and disconnects the separation fluid injector to and from the separation fluid passage, the separation fluid injector moving part is arranged outside movement areas of the polishing table, the polishing pad mount plate and the polishing pad. Thus, the polishing pad as well as the polishing pad mount plate is moved with the polishing table in the polishing direction, and the separation fluid supplying part can retract from the movement areas of the polishing table, the polishing pad mount plate and the polishing pad during polishing.

The polishing apparatus of the present invention is characterized in that: the polishing table is movable in a polishing direction; and the polishing pad mount plate moving part comprises a contact part and a moving part body which brings the contact part into contact with the polishing pad mount plate and separates the contact part from the polishing pad mount plate, the moving part body is arranged outside movement areas of the polishing table, the polishing pad mount plate and the polishing pad. Thus, the polishing pad as well as the polishing pad mount plate is moved with the polishing table in the polishing direction, and the polishing pad mount plate moving part can retract from the movement areas of the polishing table, the polishing pad mount plate and the polishing pad during polishing.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
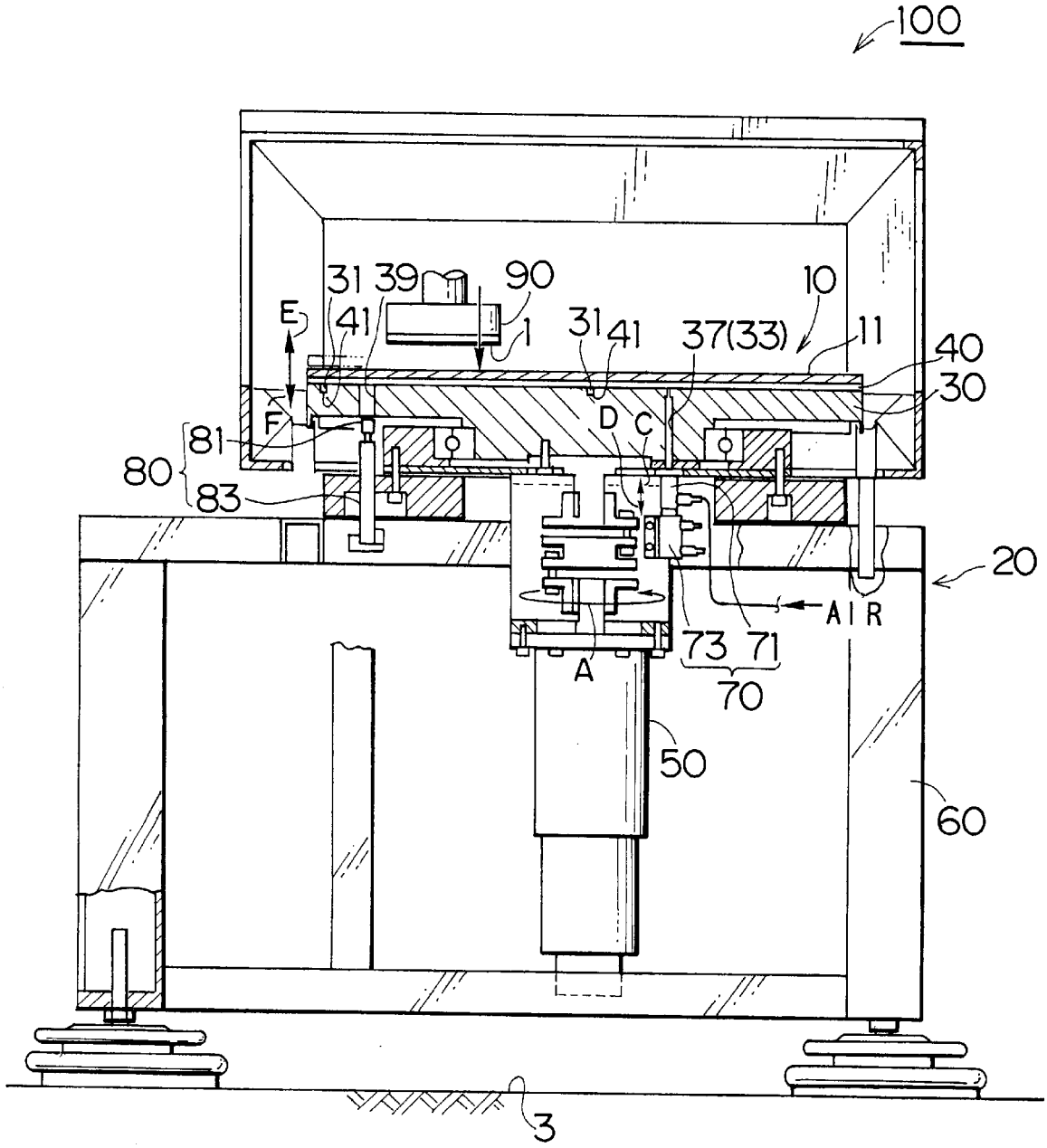
FIG. 1 is a front sectional view illustrating one embodiment of the polishing apparatus according to the present invention.

As shown in FIG. 1, a polishing apparatus 100 of the present invention comprises a polishing part 10, which polishes a semiconductor wafer 1 as a polished material, and a holding and pressing part 90, which holds the semiconductor wafer 1 and presses it against the polishing part 10 under desired polishing pressure.

The polishing part 10 is provided with a polishing pad 11, which polishes the semiconductor wafer 1. The polishing pad 11 is stuck on the top face of a pad mount plate 40, which is detachably attached on the top of a turn table 30 of a body 20. The body 20 includes the turn table 30, a rotating part 50, which supports the turn table 30 and rotates it in the direction of the arrow A parallel to the semiconductor wafer 1, a support 60, which supports the rotating part 50 and is set on the floor 3, a separation fluid supplying part 70, which supplies air of high pressure as separation fluid to a separation fluid passage 33 which will be described later, and pad mount plate moving parts 80 (one of them is shown in FIG. 1), which support and move the pad mount plate 40 up and down in the directions of the arrows E and F. The pad mount plate 40 has four engaging projections 41 at the bottom face thereof.

Figure 2:
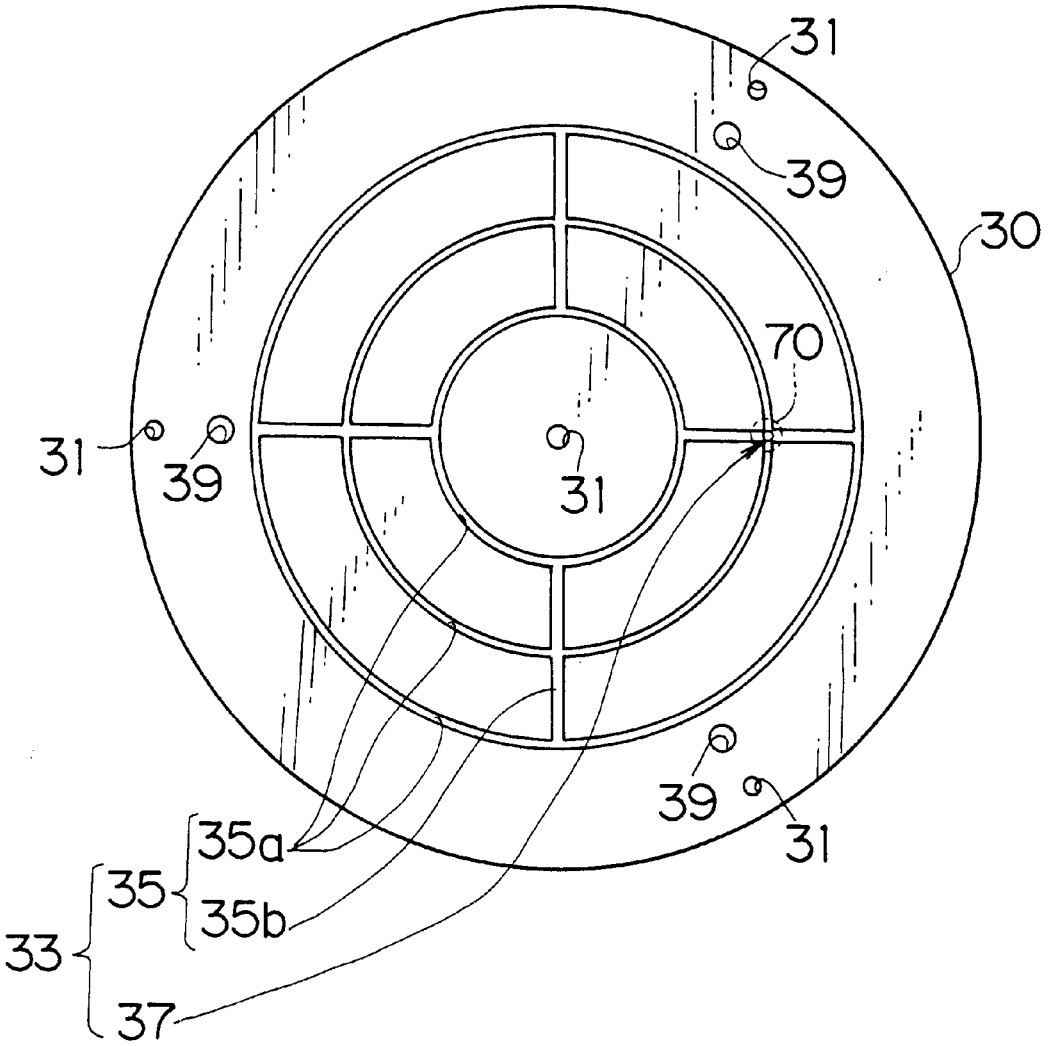
FIG. 2 is a plan view illustrating a turn table of the polishing apparatus in FIG. 1.

As shown in FIG. 2, the turn table 30 has four engaged pits 31, which are engaged with the engaging projections 41 of the pad mount plate 40, the separation fluid passage 33, which conveys air as the separation fluid to the top of the turn table 30 which is in contact with the bottom of the pad mount plate 40, and rod passage holes 39 (one of them is shown in FIG. 1), through which rods 81 of the pad mount plate moving parts 80 go.

The separation fluid passage 33 has a groove part 35, which is formed at the top face of the turn table 30 as shown in FIG. 2, and a hole part 37, which passes through the turn table 30 as shown in FIG. 1 and connects to the groove part 35. The groove part 35 of FIG. 2 is composed of a triple concentric part 35*a* and four straight parts 35*b*, which connect circles of the part 35*a*.

The separation fluid supplying part 70 supplies air as the separation fluid to the bottom end of the hole part 37 of the separation fluid passage 33 as shown in FIG. 1. The separation fluid supplying part 70 includes a separation fluid injector 71, which injects air of high pressure, and a injector moving part 73, which connects and disconnects the fluid injector 71 to and from the bottom end of the hole part 37 of the separation fluid passage 33. The injector moving part 73 is an air cylinder for example, and it is arranged outside the movement areas of the turn table 30, the pad mount plate 40 and the polishing pad 11.

As shown in FIG. 2, the rod passage holes 39 of the turn table 30 are provided at regular intervals outside the outer edge of the groove part 35.

Each of the pad mount plate moving parts 80 of FIG. 1 has the rod 81, which can be in contact with the bottom face of the pad mount plate 40, and a moving part body 83, which moves the rod 81 to bring the tip of the rod 81 into contact with the bottom face of the pad mount plate 40 through the rod passage hole 39 (in the direction of the arrow E) or pull the rod 81 out of the rod passage hole 39 (in the direction of the arrow F). The moving part bodies 83 are hydraulic cylinders for example, and they are arranged outside the movement areas of the turn table 30, the pad mount plate 40 and the polishing pad 11.

A description will be given of a method of changing the polishing pads 11 in the polishing apparatus 100.

First, the injector moving part 73 of the separation fluid supplying part 70 is activated to move the fluid injector 71 in the direction of the arrow C so that the fluid injector 71 can connect to the bottom end of the hole part 37 of the separation fluid passage 33. Then, air of high pressure is supplied between the top face of the turn table 30 and the bottom face of the pad mount plate 40 by the fluid injector 71 through the separation fluid passage 33. Thereby, the pad mount plate 40 is released from the turn table 30, even if the pad mount plate 40 sticks fast to the turn table 30 under polishing pressure with polishing liquid which permeates between the top face of the turn table 30 and the bottom face of the pad mount plate 40.

When the pad mount plate 40 is released from the turn table 30, the moving part bodies 83 of the pad mount plate moving parts 80 are activated to move the rods 81 so as to bring the tips of the rods 81 into contact with the bottom face of the pad mount plate 40 through the rod passage holes 39 and push the pad mount plate 40 up in the direction of the arrow E. Thereby, the pad mount plate 40 is supported, and is moved in the direction to become farther from the turn table 30 by the pad mount plate moving parts 80. Thus, the pad mount plate 40 can be easily and quickly detached. After the pad mount plate 40 is detached, the fluid injector 71 stops injecting.

Then, another pad mount plate 40 on which a new polishing pad 11 is stuck is attached on the turn table 30 instead of the detached pad mount plate 40. Thus, the polishing apparatus 100 stops only for a short period of time. Moreover, the detached pad mount plate 40 is moved to a place apart from the polishing apparatus 100, and the used polishing pad 11 is torn off there to thereby prevent the dust from scattering inside the polishing apparatus 100.

Thus, the polishing pads 11 can easily and quickly be changed, so hat the polishing apparatus 100 stops only for a short period of time.

After the polishing pads 11 are changed, when the rotating part 50 is activated to move the polishing pad 11 as well as the pad mount plate 40 and the turn table 30 in the polishing direction (the direction of the arrow A), the fluid injector 71 of the separation fluid supplying part 70 and the rods 81 of the pad mount plate moving parts 80 are moved in the direction of the arrows D and F, respectively, so that they can retract from the movement areas of the turn table 30, the pad mount plate 40 and the polishing pad 11 during polishing.

Accordingly, the polishing apparatus 100 of this embodiment can polish numbers of semiconductor wafers 1.

In this embodiment, the separation fluid passage 33 is provided on the turn table 30; however, it may be provided on the pad mount plate 40 or on both the turn table 30 and the pad mount plate 40.

In the present invention, the separation fluid may be any gas and liquid instead of air. For example, the separation fluid may be a lubricant which permeates between the turn table 30 and the pad mount plate 40 to reduce friction therebetween or a chemical solution which dissolves the polishing liquid.

The turn table of the present invention may be partially in contact with the pad mount plate. The contacting face should not be necessarily plane, and it may be undulating.

As set forth hereinabove, according to the present invention, when the pad mount plate is detached from the turn table, the separation fluid supplying part supplies the separation fluid between the turn table and the pad mount plate to thereby release the pad mount plate from the turn table. Thus, the pad mount plate can easily and quickly be detached.

Another pad mount plate on which a new polishing pad is stuck is attached on the turn table instead of the detached pad mount plate, so that the polishing apparatus stops only for a short period of time. The detached pad mount plate is moved to a place apart from the polishing apparatus, and the polishing pad is torn off there. Thus, the dust is prevented from scattering inside the polishing apparatus.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A polishing apparatus comprising:

a polishing table;

a polishing pad mount plate on which a polishing pad for polishing a polished material is attached, said polishing pad mount plate being detachably attached on said polishing table;

a separation fluid passage formed on at least one of said polishing table and said polishing pad mount plate;

a separation fluid supplying part which supplies separation fluid between said polishing table and said polishing pad mount plate through said separation fluid passage when said polishing pad mount plate is detached from said polishing table; and a polishing pad mount plate moving part which moves said polishing pad mount plate in a direction to become farther from said polishing table and supports said polishing pad mount plate when said polishing pad mount plate is detached from said polishing table.

2. The polishing apparatus as defined in claim 1, wherein:

said polishing table is movable in a polishing direction; and said polishing pad mount plate moving part comprises a contact part and a moving part body which brings said contact part into contact with said polishing pad mount plate and separates said contact part from said polishing pad mount plate, said moving part body is arranged outside movement areas of said polishing table, said polishing pad mount plate and said polishing pad.

3. The polishing apparatus as defined in claim 1, wherein:

said polishing table is movable in a polishing direction; and said separation fluid supplying part comprises a separation fluid injector which injects the separation fluid, and a separation fluid injector moving part which connects and disconnects said separation fluid injector to and from said separation fluid passage, said separation fluid injector moving part is arranged outside movement areas of said polishing table, said polishing pad mount plate and said polishing pad.

4. The polishing apparatus as defined in claims 3, wherein said separation fluid injector moving part comprises an air cylinder.

* * * * *